US010799740B2

(12) United States Patent
Pipe

(10) Patent No.: US 10,799,740 B2
(45) Date of Patent: Oct. 13, 2020

(54) RESIDENTIAL CONCEALED SPRINKLER

(71) Applicant: The Viking Corporation, Hastings, MI (US)

(72) Inventor: Jed Pipe, Byron Center, MI (US)

(73) Assignee: The Viking Corporation, Hastings, MI (US)

( * ) Notice: Subject to any disclaimer, the term of this patent is extended or adjusted under 35 U.S.C. 154(b) by 0 days.

(21) Appl. No.: 16/254,591

(22) Filed: Jan. 23, 2019

(65) Prior Publication Data

US 2019/0151694 A1 May 23, 2019

Related U.S. Application Data

(62) Division of application No. 15/099,564, filed on Apr. 14, 2016, now Pat. No. 10,238,903.

(51) Int. Cl.

| | |
|---|---|
| ***A62C 37/14*** | (2006.01) |
| ***A62C 37/09*** | (2006.01) |
| ***A62C 35/68*** | (2006.01) |
| ***B05B 1/26*** | (2006.01) |

(52) U.S. Cl.

CPC ..... *A62C 37/14* (2013.01); *A62C 35/68* (2013.01); *A62C 37/09* (2013.01); *B05B 1/265* (2013.01)

(58) Field of Classification Search

CPC ..... A62C 37/14; A62C 35/68; A62C 37/09; B05B 1/265

See application file for complete search history.

(56) References Cited

U.S. PATENT DOCUMENTS

| | | | | |
|---|---|---|---|---|
| 2,076,483 | A * | 4/1937 | Rowley | B05B 1/265 239/498 |
| 2,558,450 | A | 6/1951 | Martin | |
| 2,732,018 | A | 1/1956 | Grimes | |
| 4,015,665 | A | 4/1977 | Simons et al. | |
| 4,491,182 | A | 1/1985 | Pieczykolan | |
| 4,739,835 | A | 4/1988 | Polan et al. | |
| 5,664,630 | A | 9/1997 | Meyer et al. | |

(Continued)

OTHER PUBLICATIONS

New Zealand Second Examination Report dated May 22, 2019 (corresponding to NZ Application No. 746714).

(Continued)

*Primary Examiner* — Tuongminh N Pham

(74) *Attorney, Agent, or Firm* — Harness, Dickey & Pierce, P.L.C.

(57) ABSTRACT

An automatic fire protection sprinkler includes a sprinkler body having a passage with an inlet end and a discharge opening. A pair of sprinkler arms extend from the sprinkler body. The pair of sprinkler arms each include a radially inwardly extending leg including a threaded bore for receiving a compression screw. The pair of sprinkler arms each include a radially outwardly extending leg each defining an aperture therein. An outlet closure assembly includes a closure element that selectively blocks the discharge opening of the sprinkler body and a trigger assembly including a yoke that engages the compression screws and a glass bulb that extends between the yoke and the closure element. A deflector is coupled to the sprinkler arms by a pair of support pins that are received in the apertures in the radially outwardly extending legs of the at least two sprinkler arms.

1 Claim, 4 Drawing Sheets

(56) References Cited

U.S. PATENT DOCUMENTS

| | | | | |
|---|---|---|---|---|
| 6,082,463 | A | 7/2000 | Ponte | |
| 6,129,153 | A | 10/2000 | Joung | |
| 6,615,927 | B1 | 9/2003 | Kim | |
| 7,275,603 | B2 | 10/2007 | Polan | |
| 8,353,356 | B2 | 1/2013 | Rogers | |
| 8,573,316 | B2 | 11/2013 | Polan et al. | |
| 8,776,903 | B2 | 7/2014 | Jimenez et al. | |
| 8,876,067 | B2 * | 11/2014 | McAllister | F16L 41/12 239/283 |
| 9,248,327 | B2 | 2/2016 | Polan et al. | |
| 2006/0113092 | A1 | 6/2006 | Rogers et al. | |
| 2006/0219817 | A1 | 10/2006 | Franson et al. | |
| 2006/0219819 | A1 | 10/2006 | Franson et al. | |
| 2007/0215362 | A1 | 9/2007 | Rodgers | |
| 2010/0243282 | A1 | 9/2010 | Rekeny | |
| 2011/0030977 | A1 | 2/2011 | Polan et al. | |
| 2015/0297927 | A1 | 10/2015 | Pipe et al. | |

OTHER PUBLICATIONS

New Zealand First Examination Report dated Mar. 25, 2019 (corresponding to NZ Application No. 746714).
Communication pursuant to Rule 164(1) EPC dated Oct. 28, 2019 (corresponding to EP17782769.8).
Korean Office Action dated Jan. 21, 2020 (corresponding to KR 10-2018-7029996).
Chinese Office Action dated Mar. 19, 2020 with English translation (corresponding to CN 2017800231065).

* cited by examiner

RESIDENTIAL CONCEALED SPRINKLER

CROSS-REFERENCE TO RELATED APPLICATIONS

This application is a divisional of U.S. patent application Ser. No. 15/099,564, filed on Apr. 14, 2016. The entire disclosure of the above application is incorporated herein by reference.

FIELD

The present disclosure relates to fire protection sprinklers and more particularly to a residential concealed sprinkler.

BACKGROUND

This section provides background information related to the present disclosure which is not necessarily prior art.

Sprinklers have long been used in automatic fire extinguishing systems in order to controllably disburse a fluid to suppress or extinguish a fire in a designated area. Typically, the fluid utilized in automatic fire extinguishing systems is water, however systems have also been developed to disburse other fire extinguishing fluids. In one common design, sprinklers include a solid metal base with an inlet connected to a pressurized supply of water or other fire extinguishing fluid, and a deflector which alters the trajectory of the water in an optimum pattern when discharged from the base outlet orifice. In many conventional sprinklers, the deflector is fixedly spaced from the outlet by a pair of rigid arms and mounted on a boss joining the arms. A trigger element is positioned between the deflector boss and the outlet orifice closure seal.

In another common recessed, pendant version of the sprinkler, the deflector is movable and stored proximate to the base. A housing extends around the deflector and sprinkler body and forms a recess up into the ceiling in which the sprinkler is located. A fluid seal, also positioned within the interior of the sprinkler, is maintained in the closed position by a pair of levers or actuators depending below the bottom of the sprinkler body. The levers are held in an inwardly biased or closed position by a trigger mechanism which is thermally responsive in the temperature range indicative of a fire. The trigger mechanism is commonly a thermally sensitive fusible link. Thus, under normal temperatures, the presence of the thermally sensitive fusible link prohibits fluid flow from the sprinkler. When the temperature within the designated area rises to a preselected value due to a fire, the fusible link separates, causing the levers to move in an outward direction and thus permits downward movement of the deflector plate from the interior of the sprinkler to a preselected distance within the interior of the designated area. The separation of the fusible link also opens the fluid seal, thereby enabling pressurized water to travel through the sprinkler and into the designated area in order to suppress or extinguish a fire.

The prior art has advanced fusible link trigger mechanisms which also function to conceal the bottom outlet of the sprinkler. For example, U.S. Pat. No. 4,596,289 issued to Johnson discloses a combined trigger element and concealing mechanism having two complementary strut retaining members which maintain the fluid seal in a closed position. The outer surfaces of these strut retaining members are joined by a heat fusible material which is covered by a heat conductive cover. In this design, the bottom outlet of the sprinkler is entirely enclosed by the combined trigger and concealing mechanism.

The cover mechanism entirely encloses the bottom of the sprinkler, with the heat fusible material being located on the interior surface of the cover. When the temperature is elevated due to the presence of a fire in the designated area, the thermal energy issued from the fire is constrained to pass in an upward direction from the outer surface of the cover member towards the heat sensitive compound. Since the cover member completely encloses the bottom region of the sprinkler, the inner surface of the cover member and the heat sensitive agent remains at ambient or near ambient conditions until thermal energy penetrates the cover member and reaches the heat sensitive agent.

Consequently, there exists a need for a responsive and reliable combined trigger and concealing device which overcomes the difficulties encountered by the prior art.

SUMMARY

This section provides a general summary of the disclosure, and is not a comprehensive disclosure of its full scope or all of its features.

The present disclosure provides an automatic fire protection sprinkler including a sprinkler body having a passage with an inlet end and a discharge opening. A pair of sprinkler arms extend from the sprinkler body on opposite sides of the discharge opening. The pair of sprinkler arms each include a radially inwardly extending leg extending toward one another and spaced from one another. The radially inwardly extending legs each include a threaded bore for receiving a compression screw. The pair of sprinkler arms each including a radially outwardly extending leg each defining an aperture therein. An outlet closure assembly includes a closure element that selectively blocks the discharge opening of the sprinkler body and a trigger assembly including a yoke that engages the compression screws and a glass bulb that extends between the yoke and the closure element. A deflector is coupled to the sprinkler arms by a pair of support pins that are received in the apertures in the radially outwardly extending legs of the at least two sprinkler arms.

According to a further aspect of the present disclosure, the yoke includes a crossbar having a U-shaped midsection with a first recess in a first side and a pair of ends each including a second recess therein on a second side opposite the first side. An ejection structure extends from the crossbar. The yoke is made from a stamped flat blank that is stamped from sheet metal. The stamped blank can be generally "D"-shaped and includes a straight section and an arc shaped extension extending from opposite ends of the straight section. The arc shaped extension can be bent so as to be generally perpendicular to the straight section. The straight section can be stamped to include a recess at each end facing in a direction away from the bent arc shaped extension. The additional central recess can be formed in a center of the straight section facing in a direction toward the bent arc shaped extension. A midsection of the straight section is bent in a U-shape so as to extend away from the bent arc shaped extension.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
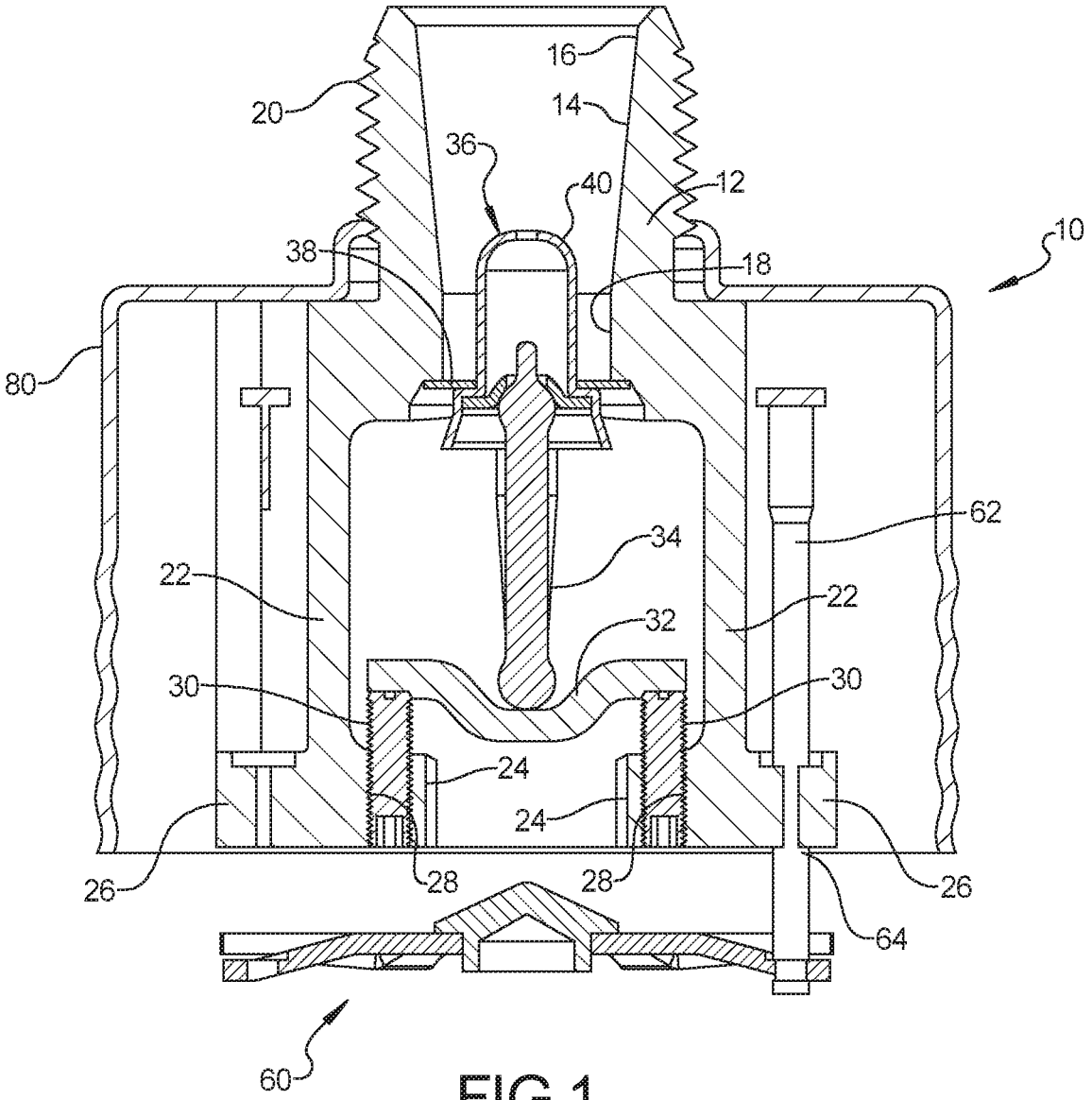
FIG. 1 is a cross-sectional view of the residential concealed sprinkler according to the principles of the present disclosure.
Figure 2:
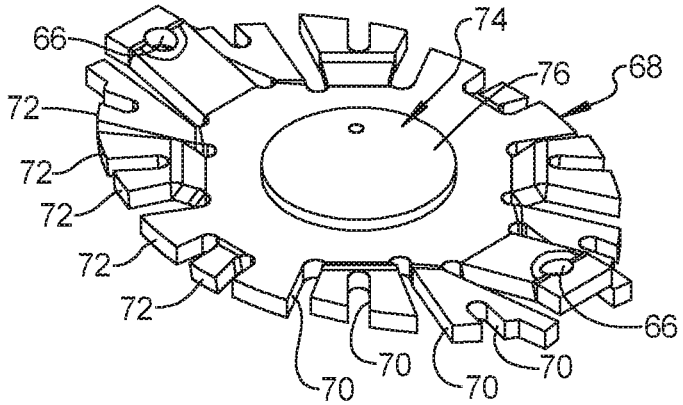
FIG. 2 is a perspective view of a deflector assembly according to the principles of the present disclosure.
Figure 3:
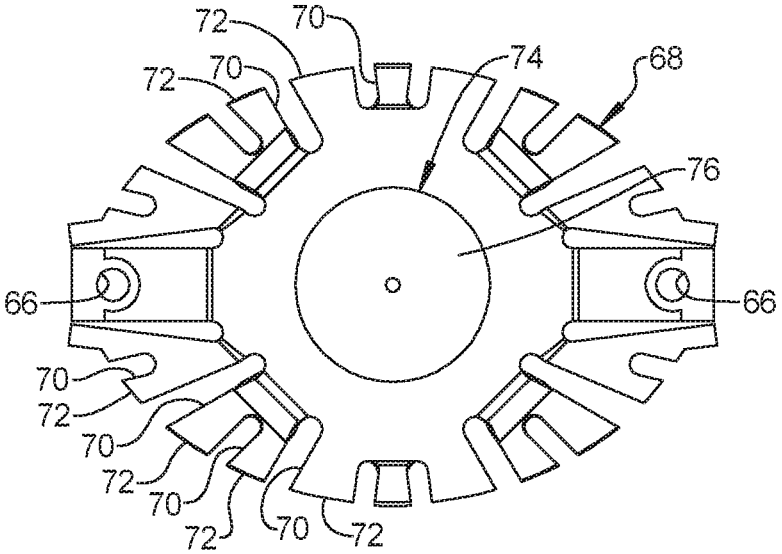
FIG. 3 is a top plan view of the deflector assembly shown in FIG. 2.
Figure 4:
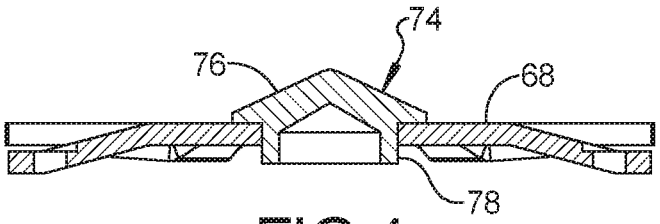
FIG. 4 is a side plan view of the deflector assembly shown in FIG. 2.
Figure 5:
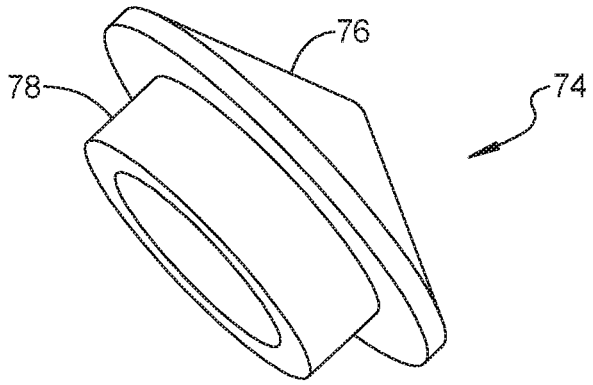
FIG. 5 is a perspective view of a deflector button according to the principles of the present disclosure.
Figure 6:
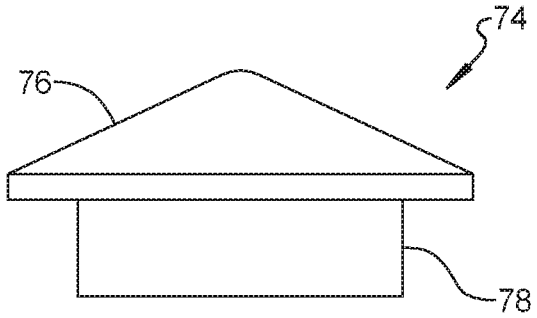
FIG. 6 is a side plan view of the deflector button shown in FIG. 5.
Figure 7:
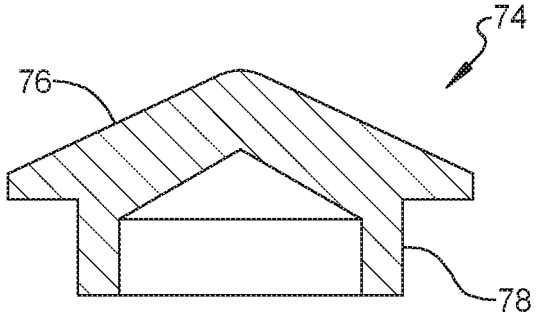
FIG. 7 is a cross-sectional view of the deflector button shown in FIG. 5.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a residential concealed sprinkler 10 according to the principles of the present disclosure will not be described. The residential concealed sprinkler 10 includes a sprinkler body 12 includes a fluid passage 14 defining an inlet opening 16 and a discharge opening 18. The body 12 includes an upper section having external threads 20. The body 12 further includes a pair of frame arms 22 spaced from one another on opposite sides of the discharge opening 18.

The pair of frame arms 22 each include a radially inwardly extending leg portion 24 and a radially outwardly extending leg portion 26. Each of the radially inwardly extending leg portions 24 includes a threaded bore 28 that receives a compression screw 30. The compression screws 30 each engage a yoke 32 that extends between the compression screws 30. The yoke 32 engages a glass bulb 34 at a distal end and a proximal end of the glass bulb 34 engages a seal assembly 36. The seal assembly 36 can include an annular spring washer 38 and pip cap assembly 40.

Figure 8:
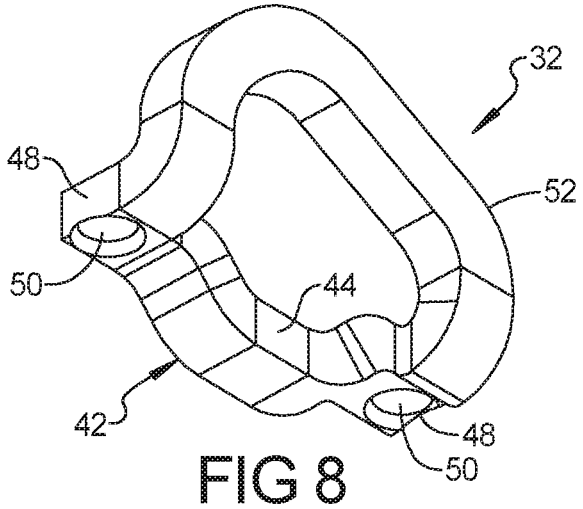
FIG. 8 is a perspective view of a yoke of a trigger assembly according to the principles of present disclosure.
Figure 9:
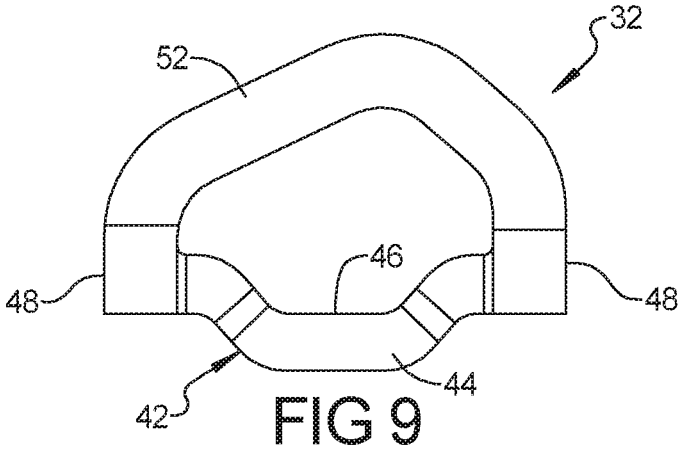
FIG. 9 is a side plan view of the yoke shown in FIG. 8.

As shown in FIG. 8, the yoke 32 includes a bent crossbar 42 having a U-shaped mid-section 44 with a center recess 46 for receiving the distal end of the glass bulb 34. The ends 48 of the crossbar 42 extend from the U-shaped mid-section and each include a recess 50 on an opposite side of the crossbar 42 from the recess 46. The yoke 32 can further include an upwardly extending ejection structure 52 disposed on one side of the crossbar 42. The ejection structure 52 provides a pivot point for causing the yoke 32 to pivot and eject outwardly from the sprinkler when the glass bulb 34 shatters due to the heat of a fire. The ejection structure 52 can be in the form of a continuous structure extending from opposite ends 48 of the crossbar 42.

Figure 10:
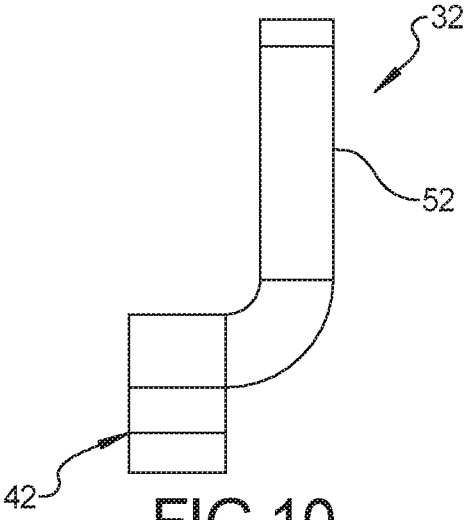
FIG. 10 is an end plan view of the yoke shown in FIG. 8.
Figure 11:
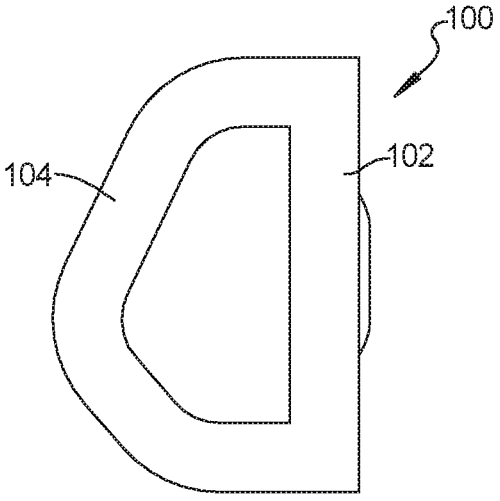
FIG. 11 is a plan view of a stamped blank used to make the yoke according to the principles of the present disclosure.

The yoke is made from a flat blank 100 that is stamped from sheet metal, as shown in FIG. 11. The stamped blank 100 can be generally "D"-shaped and includes a straight section 102 and an arc shaped extension 104 extending from opposite ends of the straight section 102. The arc shaped extension 104 can be bent so as to be generally perpendicular to the straight section 102, as shown by the bent extension portion 52 in FIGS. 8 and 10. The straight section 102 can be stamped to include the recess 50 at each end facing in a direction away from the bent arc shaped extension 52. The additional central recess 46 can be formed in a center of the straight section 102 facing in a direction toward the bent arc shaped extension 52. The midsection of the straight section 102 is bent in a U-shape 44 so that the base of the U extends away from the bent arc shaped extension 52.

A deflector assembly 60 is supported to the pair of radially outwardly extending legs 26 of the sprinkler body 12 by a pair of support pins 62 that are received in apertures 64. The support pins 62 are engaged with apertures 66 provided in a deflector plate 68. The deflector plate 68 can be oval shaped and include a plurality of slots 70 extending inward from an outer periphery of the plate 68 to define a plurality of tines 72 so as to provide a desired spray pattern. The size and shape of the slots 70 can be selected to provide a desired flow pattern in order to distribute water being discharged from the discharge opening 18 so as to meet the necessary distribution pattern for suppressing a fire in a desired coverage area. A deflector button 74 can be secured to a center of the deflector plate 68. The deflector button 74 can be sized and shaped to distribute the flow of water through the discharge opening 18 radially outward across the surface of the deflector plate 68. The deflector button 74 can have a cone shaped face 76 and a cylindrical base 78 that is staked to the deflector plate 68.

A can-shaped housing 80 can be mounted to the sprinkler body 12. As is well known in the art, a cover assembly (not shown) can be mounted to the can-shaped housing 80 for concealing the sprinkler 10 in an assembled condition.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of making a yoke for a fire protection sprinkler, comprising:

stamping a D-shaped flat blank from sheet metal includes a straight section and an arc-shaped extension having an arc-shaped body with a midsection spaced from the straight section and having opposite ends extending from and connected to opposite distal ends of the straight section;

bending the arc-shaped extension of the D-shaped flat blank relative to the straight section;

bending the straight section of the blank to form a U-shaped midsection of a crossbar;

stamping a first pair of recesses in opposite distal ends of the crossbar, the first pair of recesses facing in a direction away from the bent arc-shaped extension; and forming an additional central recess in a center of the U-shaped midsection of the crossbar facing in a direction toward the bent arc-shaped extension.

* * * * *